US005759056A

United States Patent [19]

Costello et al.

[11] Patent Number: 5,759,056

[45] Date of Patent: Jun. 2, 1998

[54] INTERLOCKABLE EYELET TERMINAL

[75] Inventors: Martin David Costello, Garden City, Mich.; James Thomas Jetton, Toledo, Ohio

[73] Assignee: Yazaki Corporation, Tokyo, Japan

[21] Appl. No.: 685,354

[22] Filed: Jul. 24, 1996

[51] Int. Cl.[6] ..... H01R 25/00

[52] U.S. Cl. ..... 439/290; 439/868

[58] Field of Search ..... 439/290, 288, 439/287, 883, 860, 868

[56] References Cited

U.S. PATENT DOCUMENTS

| | | | |
|---|---|---|---|
| 4,795,380 | 1/1989 | Frantz | 439/860 |
| 4,832,629 | 5/1989 | Sasaki et al. | 439/889 |
| 5,529,509 | 6/1996 | Hayes et al. | 439/288 |

FOREIGN PATENT DOCUMENTS

| | | |
|---|---|---|
| 58-1982 | 1/1983 | Japan . |
| 63-12541 | 4/1988 | Japan . |
| 63-28536 | 8/1988 | Japan . |

*Primary Examiner*—Khiem Nguyen
*Assistant Examiner*—Eugene G. Byrd
*Attorney, Agent, or Firm*—Young & Basile, P.C.

[57] ABSTRACT

An eyelet terminal comprises a ring with a plurality of tabs formed around the inner circumference thereof, the tabs projecting out of the plane of the ring and adapted to interlockingly engage tabs of identical terminals to secure the terminals to one another in a stacked, coaxial configuration prior to the terminals being bolted to a surface. A terminal may be secured to an adjacent terminal in any of several alternative relative angular positions. In one embodiment, the tabs are canted about a radially extending line to lie in a plane oblique to the plane of the ring and project below a lower surface of the ring such that sharp edges of the tabs are urged into contact with the surface to which the terminal stack is bolted. In another embodiment, the tabs are stair-step shaped and extend only above an upper surface of the ring.

10 Claims, 4 Drawing Sheets

INTERLOCKABLE EYELET TERMINAL

FIELD OF THE INVENTION

This invention relates to eyelet terminals such as are used to connect electrical wires to ground or to other electrical system components, and more particularly to eyelet terminals that are interlockable with one another prior to said connection.

BACKGROUND OF THE INVENTION

Eyelet terminals are used in automotive vehicle electrical systems to connect wires to electrical ground or to other electrical system components. An eyelet terminal is essentially a flat ring of electrically conductive metal with a radially extending portion for connection to the end of a length of wire by crimping or soldering. In a typical grounding connection, the eyelet terminal is fastened to a piece of sheet metal such as a vehicle body panel by a bolt passing through the ring.

It is sometimes desirable to attach two or more eyelet terminals to a common grounding point, and this is easily accomplished by passing a single bolt through the eyelets of a series of terminals before fastening it to the grounding point. In some such situations, it may be advantageous to secure the terminals to one another independently of the bolt. This allows the terminals to be assembled into a unit prior to bolting to the grounding point, and keeps the terminals joined together when they are unbolted from the grounding point as is sometimes necessary during maintenance operations.

Japanese publication 63-28536 discloses an eyelet terminal that may be interlocked with other identical terminals. The interlocking feature is provided by first and second stair-step shaped tabs formed at diametrically opposed locations on the outer circumferential edge of the ring, the tabs projecting out of the plane of the ring toward an upper side of the ring. When two such terminals are placed one on top of the other and rotated relative to one another, the upper steps of the tabs projecting from the lowermost terminal slide over and engage the lower steps of the tabs on the uppermost terminal to hold the two terminals in planar contact and coaxial alignment with each other. While providing for effective interlocking of multiple terminals, the tabs create an irregular edge on the outside of the ring. It has been found that when such terminals are packaged in bulk after being crimped to wires, the irregular edges of the tabs are likely to come into contact with and snag on the wires, sometimes damaging the wire insulation when the package is subjected to normal shipping and handling.

When two or more eyelet terminals are stacked atop one another and bolted to a single point, it is sometimes desirable to be able to control the radial directions in which the attached wires extend from that point. This permits routing of the wires in the proper directions to reduce tangling of the wires with one another and provides for a neater wiring installation. This objective is more easily achieved if it is possible to select the angular orientation of the eyelet terminals relative to one another when they are interlocked.

SUMMARY OF THE INVENTION

It is an object of the invention to provide an eyelet terminal having interlocking means permitting the terminal to be secured to one or more identical terminals when in use, and which interlocking means is positioned on the terminal so as to reduce the likelihood of the interlocking means causing damage to associated wiring during shipment and handling of the terminal.

Another object of the invention is to provide an eyelet terminal having means for achieving improved electrical contact with a metal component to which the eyelet is connected.

A further object of the invention is to provide an eyelet terminal that is securable in stacked fashion with a plurality of identical terminals, each terminal being interlockable in any of four or more different angular positions relative to the adjacent terminal in the stack.

The invention eyelet terminal is of the type which is bolted to a metal component in order to electrically ground a wire attached to the terminal. The eyelet terminal comprises a substantially planar ring, wire connecting means joined to the ring adjacent its outer edge, and interlocking means disposed on the ring and projecting out of the plane of the ring for engaging mating interlocking means on a substantially identical second terminal when respective rings of the eyelet terminal and the second terminal are stacked on top of one another.

According to the invention, the interlocking means comprises a plurality of circumferentially spaced tabs formed integrally with the inner circumferential edge of the ring, rather than the outer edge of the ring as in the prior art. In this inner position, the irregular edges of the interlocking means are less likely to contact and possibly damage attached wiring when the terminals are packaged and shipped in bulk.

In a first embodiment of the invention, each of the tabs comprises a lower step lying in the plane of the ring and extending radially inward from the inner circumferential edge of the ring, a riser extending substantially perpendicularly from a radial edge of the lower step, and an upper step extending from the edge of the riser distal from the lower step and in a circumferential direction with respect to the ring and parallel to the plane of the ring. When such an eyelet terminal is placed coaxially on top of another identical terminal and rotated with respect thereto, the upper step of each tab on the lower ring hooks over the lower step of a tab on the upper ring to secure the two terminals in planar contact with one another.

In a second embodiment of the invention, each of the tabs is substantially flat, extends radially inward from the inner circumferential edge of the ring, and is canted about a radial line to lie in a plane oblique with the plane of the ring, the direction and angle of the cant being substantially identical for all of the tabs. Each tab thus has a first end which projects toward an upper side of the ring and a second end which projects toward a lower side of the ring. The upwardly protecting tab ends engage tabs of a second, identical terminal placed on top of the terminal, while the downwardly projecting ends are urged into contact with a metal grounding surface when the terminals are bolted thereto. The edges of the downwardly projecting ends of the tabs are relatively sharp and tend to cut through any paint, corrosion or other material covering the metal grounding surface that may tend to interfere with electrical contact between the surface and the terminal ring.

According to a further feature of the invention, the tabs are identical to one another and are spaced evenly around the inner edge of the ring, whereby each of the tabs is alternatively engagable with any of the tabs of the mating/second terminal when the terminals are secured to one another. The two eyelet terminals may thus be secured to one another in a number of alternative, angular positions relative to one another equal to the number of tabs formed on each ring, thereby providing control over the relative directions in which the wires attached to the terminals extend.

According to yet another feature of the invention, a plurality of circumferentially spaced notches equal to the number of tabs are formed in the ring, and a locking nub projects from one of the surfaces of the ring. When two identical eyelet terminals are in planar contact with one another and their respective tabs are engaged, the locking nub of a first terminal engages one of the notches of a mating terminal to secure the respective terminals against rotation relative to one another and so prevent the respective tabs from becoming disengaged. Two or more of the invention terminals will maintain stacked engagement with one another prior to being bolted into contact with a grounding surface.

DETAILED DESCRIPTION OF THE PREFERRED EMBODIMENT

Figure 1:
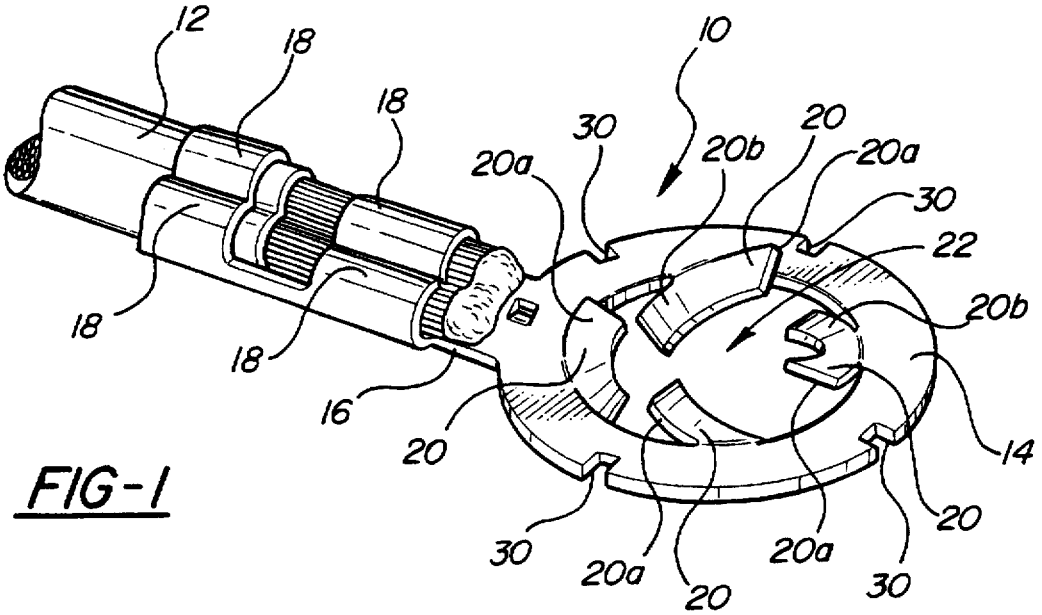
FIG. 1 is a perspective view of a first embodiment of the invention eyelet terminal.
Figure 2:
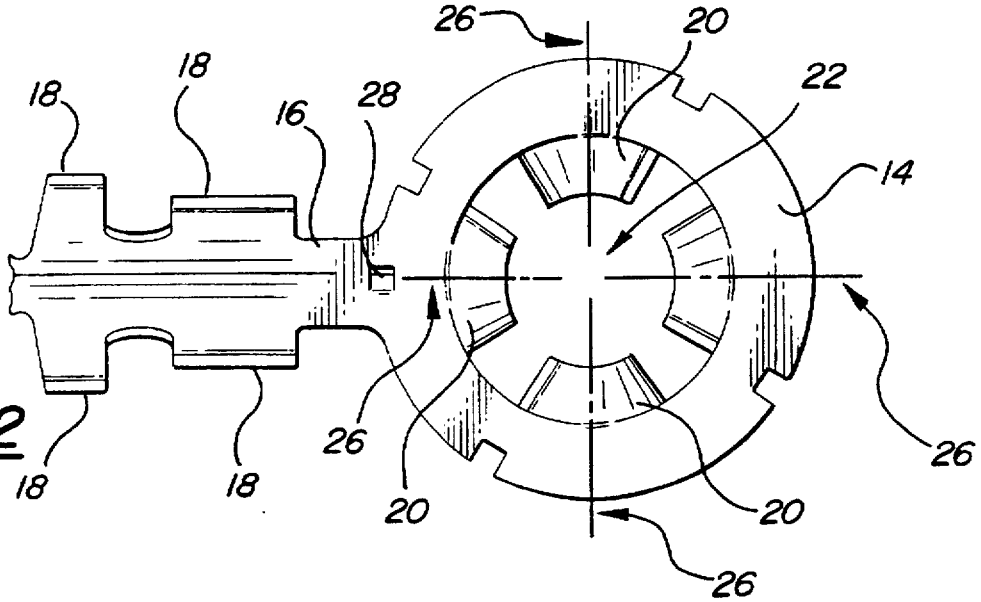
FIG. 2 is a plan view of the terminal of FIG. 1.
Figure 7:
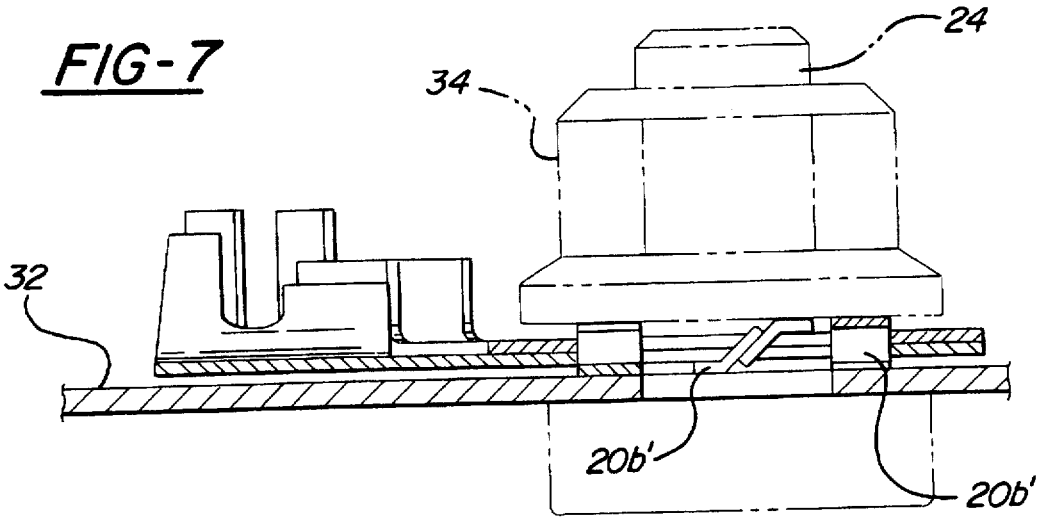
FIG. 7 is a side view of the terminals of FIG. 4 fastened to a panel by means of a nut and bolt.
Figure 8:
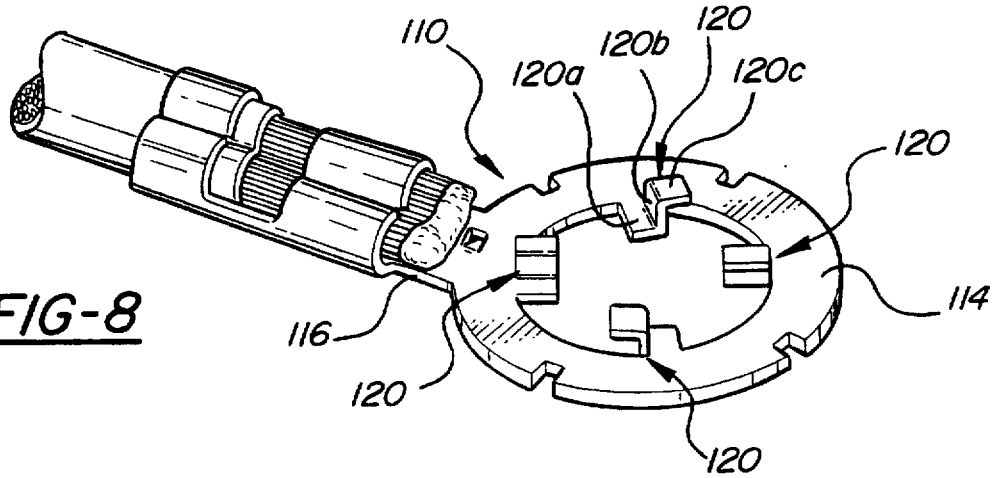
FIG. 8 is a perspective view of a second embodiment of the invention terminal.
Figure 9:
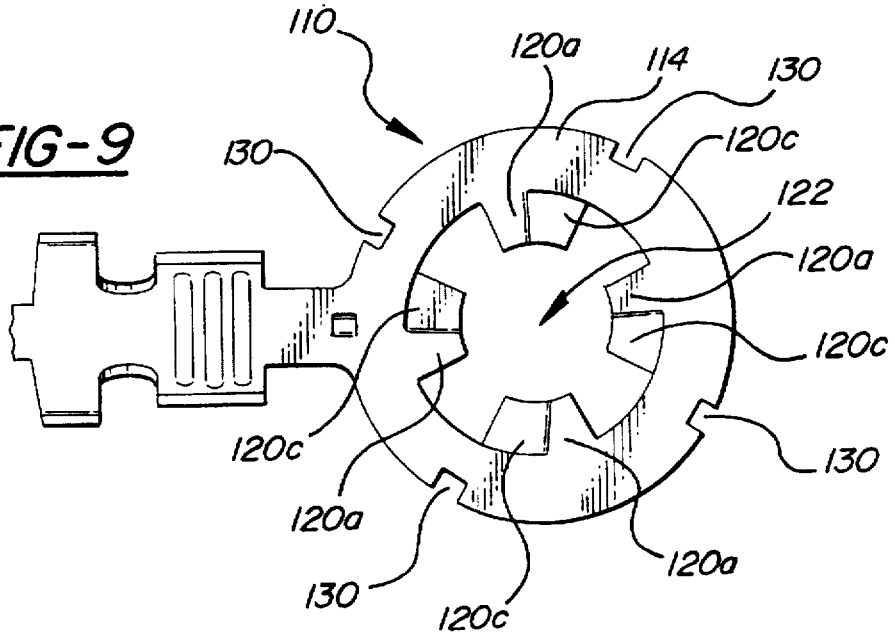
FIG. 9 is a plan view of the terminal of FIG. 8.
Figure 10:
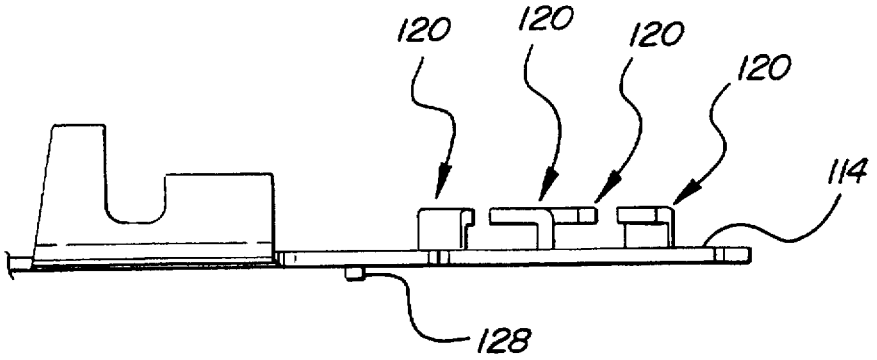
FIG. 10 is a side view of the terminal of FIG. 8.

An eyelet terminal 10 according to the present invention is shown in FIG. 1 attached to an electrical wire 12. Eyelet terminal 10 is formed of an electrically conductive metal such as steel or aluminum, preferably by a conventionally known metal stamping process, and comprises a flat ring 14 and a wire connecting stem 16 extending radially outward from the outer edge of the ring. Wire connecting stem 16 has crimping tabs 18 projecting toward an upper surface of eyelet terminal 10 to encircle wire 12, while the opposite lower surface of the terminal is substantially planar. Four arcuate tabs 20 are spaced evenly around the inner edge of the ring and are canted to lie in planes oblique to the plane of ring 14. As best seen in FIG. 2, the curved inner edges of tabs 20 define a central aperture 22. Central aperture 22 is of proper diameter to permit passage therethrough of a bolt 24 as seen in FIG. 7.

Each tab 20 is canted about an imaginary line 26 oriented radially with respect to ring 14 and passing through the approximate center of the arc of its respective tab. The direction and angle of cant is substantially identical for all of the tabs. Each tab is connected to ring 14 only adjacent the center of its arc, so that an upper radial edge **20*a* of each tab extends above an upper surface of the ring and the opposite lower radial edge 20*b* extends below the lower surface of the ring, as is best seen in FIG. 3**.

Figure 3:
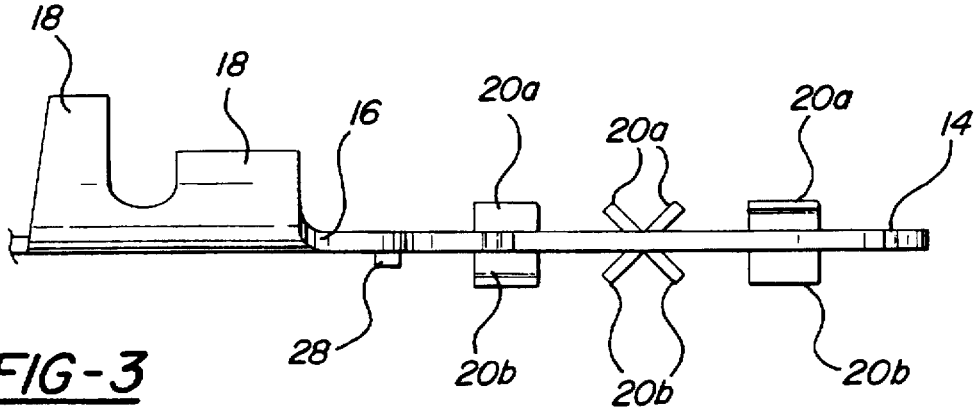
FIG. 3 is a side view of the terminal of FIG. 1.

A locking nub 28 is located on ring 14 near connecting stem 16, the locking nub protruding below the lower surface of ring 14 slightly as seen in FIG. 3. Four notches 30 are formed at evenly spaced positions around the outer circumference of ring 14.

Figure 4:
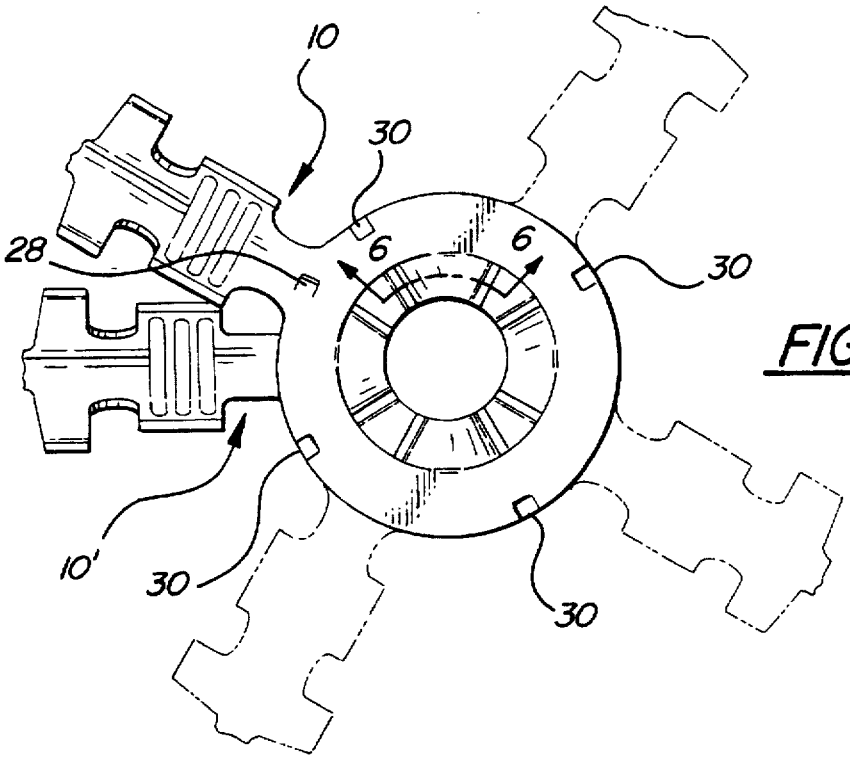
FIG. 4 is a plan view of two of the terminals of FIG. 1 interlocked with one another.
Figure 5:
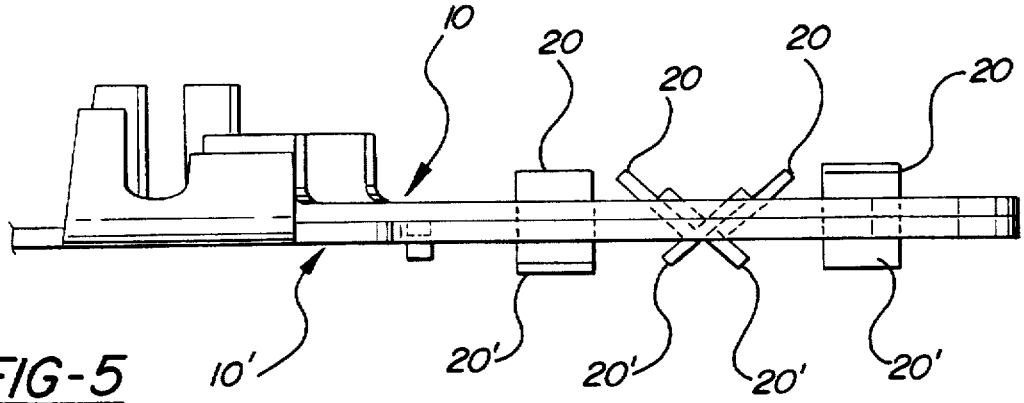
FIG. 5 is a side view of the terminals of FIG. 4.
Figure 6:
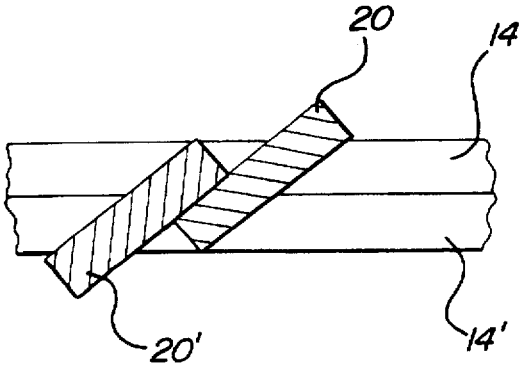
FIG. 6 is a view taken along line A—A of FIG. 4.

Two of the invention eyelet terminals 10, 10' are interlockable with one another in any of four relative positions, as seen in FIGS. 4 and 5. Interlocking of the terminals is achieved by placing a first terminal 10 on top of a second terminal 10' such that the tabs 20, 20' of the respective terminals are interleaved with one another, then rotating the upper terminal in a counterclockwise direction relative to the lower terminal until the tabs of the upper terminal are in planar contact with the adjacent tabs of the lower terminal. Notches 30 are positioned on ring 14 so that when the two terminals are in any one of the four engaged positions, locking nub 28 of the upper terminal is aligned with one of the notches and projects into that notch to inhibit rotation away from the engaged position.

Because the tabs are evenly spaced around the circumference of the terminal, two terminals are interlockable with one another in any of four relative positions, three alternative positions being indicated in phantom lines in FIG. 4. Any number of the invention eyelet terminals may be interlocked in series to form a stack, and each terminal added to the stack may be secured to its adjacent terminal in any of four relative angular positions, separated by 90°.

Terminals according to the present invention may be formed with more than four tabs if desired, providing a number of alternative relative interlocking positions equal in number to the number of tabs on each terminal.

As shown in FIG. 7, interlocked terminals 10, 10' are secured to a grounding surface such as a sheet metal panel 32 by placing them over a bolt 24 projecting from the panel and threading a nut 34 onto the bolt to compress the terminals into contact with the panel. Lower radial edges **20*b*' of lower terminal 10' projecting below the plane of the ring are urged into contact with panel 32, resulting in some deflection of tabs 20' when nut 34 is tightened. The relatively sharp radial edges 20*b*' tend to cut through any paint, corrosion or other coating that may be present on panel 32 and so into contact with the metal of the panel, thereby providing a more positive electrical connection with the panel than is achieved merely by planar contact between the lower surface of ring 14** and the panel.

An alternative embodiment of the invention shown in FIGS. 8–13. An eyelet terminal 110 has an overall configuration generally similar to that of the first embodiment described hereinabove, comprising a flat ring 114, a wire connecting stem 116 extending radially outward from the outer edge of the ring, and four tabs 120 formed integrally with the inner edge of the ring and extending radially inward therefrom to define a central aperture 122 of proper diameter to receive a bolt.

Tabs 120 are "stair-step" shaped, each comprising a lower step **120*a* extending radially inward from the inner circumferential edge of ring 114 and lying in the same plane as the ring, a riser 120*b* extending substantially perpendicularly from a radial edge of the lower step, and an upper step 120*c*** extending from an edge of the riser distal from the lower step and in a circumferential direction with respect to the ring to lie parallel to the lower step.

Figure 11:
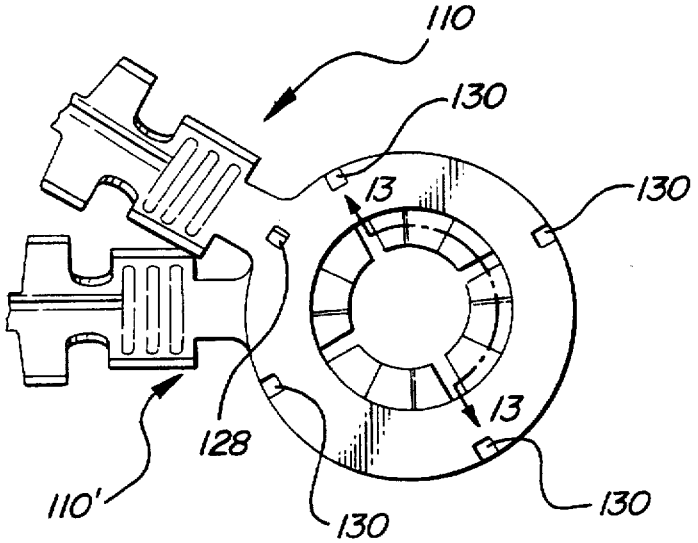
FIG. 11 is a plan view of two of the terminals of FIG. 8 interlocked with one another.
Figure 12:
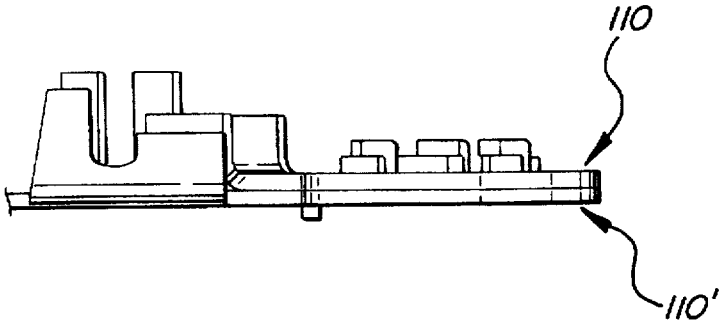
FIG. 12 is a side view of the terminals of FIG. 11.
Figure 13:
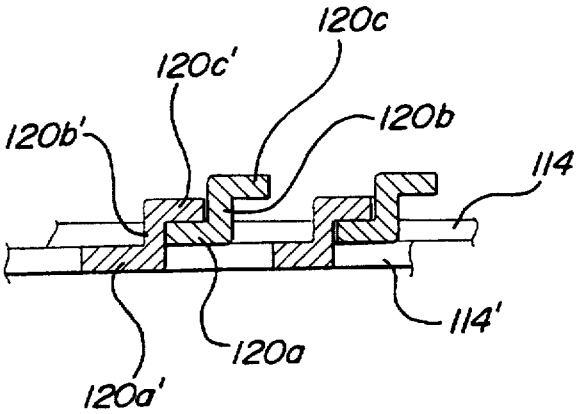
FIG. 13 is a view taken along line B—B of FIG. 11.

Two of the invention eyelet terminals 110, 110' are interlockable with one another in any of four relative angular positions, as seen in FIGS. 11 and 12, by placing one terminal 110 on top of the other terminal 110' with the tabs 120, 120' of the respective terminals interleaved with one another, then rotating the upper terminal in a counterclockwise direction relative to the lower terminal, thereby sliding the lower terminal upper steps 120c' over the upper terminal lower steps 120a. Notches 130 are positioned on ring 114 so that when the two terminals are in any one of the four engaged positions, locking nub 128 of the upper terminal is aligned with one of the notches and projects into that notch to inhibit rotation away from the engaged position.

Tabs 120 do not project below the lower surfaces of ring 114 and so do not interfere with planar contact between the surface of the ring and a panel when eyelet terminals 110, 110' are bolted thereto. This may be desirable for certain applications, for example when it is preferred to use an eyelet terminal that will not scratch or otherwise damage the surface to which it is attached.

As is apparent from the above description read in combination with the drawings, the present invention provides an interlockable eyelet terminal that is less likely to damage associated wiring during shipment and handling of the terminal, achieves improved electrical contact with a metal component to which the eyelet is connected, and is interlockable in any of four or more different angular position relative to the adjacent terminal in the stack.

The invention claimed is:

1. An eyelet terminal engageable with first and second mating terminals substantially identical with the eyelet terminal, the eyelet terminal comprising:

a substantially planar ring having an upper and a lower side and an inner circumferential edge;

wire connection means joined to the ring; and interlocking means for simultaneously engaging the first and second mating terminals when respective rings of the eyelet terminal and the first and second mating terminals are coaxially aligned with one another and the upper side of the eyelet terminal is in planar contact with a lower side of the first mating terminal and the lower side of the eyelet terminal is in planar contact with an upper side of the second mating terminal, said interlocking means projecting out of the plane of the ring and disposed adjacent the inner circumferential edge of the ring.

2. An eyelet terminal according to claim 1 wherein the interlocking means comprises a plurality of circumferentially spaced tabs formed integrally with the ring.

3. An eyelet terminal according to claim 2 wherein the tabs are spaced evenly around the inner circumferential edge of the eyelet terminal.

4. An eyelet terminal according to claim 2 wherein each of the tabs comprises:

a lower step extending radially inward from the ring and lying in the plane of the ring;

a riser extending substantially perpendicularly from a radial edge of the lower step; and an upper step extending from an edge of the riser distal from the lower step and in a circumferential direction with respect to the ring and parallel to the plane of the ring, each upper step engageable with a respective lower step of the first mating terminal and each lower step engageable with a respective upper step of the second mating terminal.

5. An eyelet terminal according to claim 2 wherein each of the tabs is substantially flat, extends radially inward from the inner circumferential edge of the ring, and is canted about a line oriented radially with respect to the ring and passing through the approximate center of the tab, each tab lying in a plane oblique with the plane of the ring, the direction and angle of the cant being substantially identical for all of the tabs.

6. An eyelet terminal according to claim 2 wherein a plurality of circumferentially spaced notches are formed in the ring and a locking nub projects from one of the surfaces of the ring, the number of notches being equal to the number of tabs and the locking nub being alternatively engagable with each of the notches of the mating terminal when the respective rings are in planar contact with each other to secure the respective tabs of the rings against rotation with respect to one other.

7. An eyelet terminal according to claim 1 wherein the interlocking means projects out of the plane of the ring toward both the upper and lower sides of the ring.

8. An eyelet terminal having wire connection means, a substantially planar ring joined to the wire connection means and having a first side for contacting a surface and an opposite second side, and interlocking means disposed on the ring and projecting out of the plane of the ring for engaging a mating terminal substantially identical with the eyelet terminal when respective rings of the eyelet terminal and the mating terminal are coaxially aligned and in planar contact with one another, the eyelet terminal characterized in that:

the interlocking means projects out of the plane of the ring toward both the first and second sides of the ring.

9. An eyelet terminal according to claim 8 wherein the interlocking means comprises a plurality of tabs formed integrally with the ring and spaced around the circumference thereof, each of the tabs extending radially inward from an inner circumferential edge of the ring and canted about a radial line to lie in a plane oblique with the plane of the ring.

10. An eyelet terminal having wire connection means, a substantially planar ring joined to the wire connection means and having an inner circumferential edge, and a plurality of circumferentially spaced tabs formed integrally with the ring adjacent the inner circumferential edge and projecting out of the plane of the ring for engaging a mating terminal substantially identical with the eyelet terminal when respective rings of the eyelet terminal and the mating terminal are coaxially aligned and in planar contact with one another, each of the tabs comprising:

a lower step extending radially inward from the ring and lying in the plane of the ring;

a riser extending substantially perpendicularly from a radial edge of the lower step; and an upper step extending from an edge of the riser distal from the lower step and in a circumferential direction with respect to the ring and parallel to the plane of the ring, each upper step engageable with a respective lower step of the mating terminal.

* * * * *